US006296459B1

(12) United States Patent
Saputo et al.

(10) Patent No.: US 6,296,459 B1
(45) Date of Patent: Oct. 2, 2001

(54) ELECTRIC AIR PUMP HAVING MULTIPLE IMPELLERS AND METHOD

(75) Inventors: Richard A. Saputo, Tarazana, CA (US); Hua Hsiang Lin, Kowloon (HK)

(73) Assignee: Intex Recreation Corp., Long Beach, CA (US)

( * ) Notice: Subject to any disclaimer, the term of this patent is extended or adjusted under 35 U.S.C. 154(b) by 0 days.

(21) Appl. No.: 09/505,153

(22) Filed: Feb. 15, 2000

(51) Int. Cl.[7] ..... F04D 17/00

(52) U.S. Cl. ..... 417/423.14; 417/244; 415/208.2

(58) Field of Search ..... 417/366, 371, 417/244, 423.1, 423.15, 423.14, 234; 415/208.2, 209.2, 184, 185, 191

(56) References Cited

U.S. PATENT DOCUMENTS

| | | | | |
|---|---|---|---|---|
| 2,331,076 | * | 10/1943 | Meldahl | 415/208.2 |
| 2,604,501 | * | 7/1952 | Wightman | 417/423.1 X |
| 3,171,353 | * | 3/1965 | McMahan | 415/208.2 X |
| 3,297,241 | * | 1/1967 | Andréasson | 417/244 |
| 3,635,589 | | 1/1972 | Kristiansen | 416/193 |
| 3,876,330 | | 4/1975 | Pearson et al. | 416/92 |
| 3,918,828 | | 11/1975 | Kumm | 415/61 |
| 4,125,345 | * | 11/1978 | Yoshinaga et al. | 417/244 X |
| 4,204,810 | * | 5/1980 | Vogel | 417/244 |
| 4,462,751 | * | 7/1984 | Smith et al. | 415/208.2 X |
| 4,734,008 | | 3/1988 | Roth | 415/53 |
| 4,978,281 | * | 12/1990 | Conger, IV | 417/423.15 |
| 5,295,367 | * | 3/1994 | Keltner | 417/234 X |
| 5,388,970 | | 2/1995 | Muckelmann et al. | 417/363 |
| 5,888,053 | * | 3/1999 | Kobayashi et al. | 417/244 |

OTHER PUBLICATIONS

Greene, R. (ed.), Modern Plastics Encyclopedia, Oct. 1991, McGraw–Hill (New York), pp. 79–80.*

* cited by examiner

*Primary Examiner*—Charles G. Freay
*Assistant Examiner*—David J. Torrente
(74) *Attorney, Agent, or Firm*—Lewis, D'Amato, Brisbois & Bisgaard, LLP

(57) ABSTRACT

An electric air pump having multiple impellers parallel mounted on the same motor shaft and typically employed for providing a source of low pressure, high volume air for charging inflatable devices. The multiple impellers provide improved motor efficiency in heat dissipation and air volume delivery when compared to a single impeller motor operating at the same RPM, and exhibits a near zero True Indicator Reading (TIR). In its most fundamental embodiment, the electric air pump having multiple impellers exhibits a construction including an outer housing having an air intake port and an air exhaust port. An electric motor is mounted within the outer housing and includes a rotating output shaft. A plurality of air impellers each parallel mounted on the rotating output shaft is employed for drawing a volume of air through the air intake port and across the electric motor. An air compressor chamber is positioned between the electric motor and the air impellers for collecting the air while the air impellers compress and exhaust the air through the air exhaust port for providing a supply of pressurized air.

15 Claims, 8 Drawing Sheets

ELECTRIC AIR PUMP HAVING MULTIPLE IMPELLERS AND METHOD

BACKGROUND OF THE INVENTION

1. Field of the Invention

The present invention relates to air pumps. More specifically, the present invention relates to methods and apparatus for an electric air pump having multiple parallel impellers mounted upon the same motor shaft for increasing the dissipation of heat from an electric motor in the pump and the efficiency of delivering low pressure, high volume air as desired to, for example, an inflatable device, or in the alternative, exhausting air from an inflated device.

2. Description of the Prior Art

The prior art is directed to methods and apparatus for electrically driven pumps having a rotating impeller or fan with a plurality of blades for moving fluids or gases typically in compressors, pumps, electrical appliances, and the like.

All alternating current (AC) and direct current (DC) electrical air pumps and some electrical appliances such as, for example, hair dryers utilize a fan blade or an air impeller to gather and subsequently force air through an opening known as an exhaust port. The movement of the air through the exhaust port results in achieving the desired goal of, for example, inflating a product in the case of an inflatable device or creating a stream of forced air to dry the hair in the case of a hair dryer.

Nominally, there are three types of electric air pumps. They include (a) low pressure, high volume pumps that are typically used to inflate toys, air mattresses and other inflatable devices, (b) high pressure, low-to-medium air volume pumps that are employed to inflate bicycle tires and sports equipment such as basketballs, footballs, volleyballs and the like, and (c) high pressure, high volume pumps generally referred to as air compressors that employ a pressure chamber for inflating such items as automobile tires or for use in construction projects. Each of these conventional types of electric air pumps typically include a motor that drives a single fan blade or impeller at a fixed number of revolutions per minute (RPM) and is useful in inflating products.

Many examples of electrical driven pumps are known in the prior art. A first example is directed to a double impeller wheel for axial flow fans comprising a set of inner impeller blades surrounded by an intermediate ring, a set of outer impeller blades secured to the ring, where the width of the ring in the axial direction is less than that of the impeller blades. The first example teaches a non-parallel double impeller blade mounted on a single shaft. In a second example, a fluid flow detector member for a rotor blade typically found in a gas turbine projects outwardly from the radially outer end of the blade into a region of leakage fluid flow. An exchange of momentum occurs between the flow of the leakage fluid and the detector surface. The detector member thus transmits a force to the blade acting in the direction of blade rotation. The second example teaches multiple parallel impellers mounted upon a common rotating shaft. A third example teaches a flow control mechanism for compressors and pumps having a vane equipped guide element disposed in a fluid compressor or pump between the usual impeller and the fluid flow inlet. A flow control means includes a rotary guide member fixed on one end of a shaft supported for rotation in a bearing at the outer end of and in alignment with the axis of the impeller. The guide member includes a hub and radially outward projecting blades.

A fourth example teaches an open vane regenerative impeller for a submerged fuel pump wherein the impeller has a ring-like body portion for which a plurality of open-vane impeller vanes extend radially outward and a plurality of fan blades extend radially inward. A final example teaches an electrically driven air pump for a motor vehicle for pumping secondary air into the exhaust gas system to improve the properties of the exhaust gases. The air pump includes a housing, a pump mechanism in the housing, and an electric motor in the housing connected in driving relation to the pump mechanism. An air passage in the housing provides a flow of air past the electric motor to the pumping mechanism. The air passage includes a suction nozzle for supplying air to an inlet collar of a pump impeller of a pump mechanism. The suction nozzle projects into the collar to supply air from the electric motor to the pump mechanism. A single impeller is shown attached to a motor shaft.

Thus, there is a need in the art for an electric air pump having multiple impellers which are parallel mounted on the same motor shaft where the multiple impellers provide improved motor efficiency in heat dissipation and air volume delivery when compared to a single impeller motor operating at the same RPM, and where the multiple parallel mounted impellers exhibit dimensions sufficiently exact so that a near zero True Indicator Reading (TIR) can be accomplished by manual assembly of the components of the motor.

SUMMARY OF THE INVENTION

Briefly, and in general terms, the present invention provides a new and improved electric air pump having multiple impellers and method therefore which is typically employed for charging an inflatable device (not shown) with a stream of forced air. In the alternative, the electric air pump of the present invention can be utilized to exhaust air from an inflatable device. Generally, the electric air pump is comprised of a motor and a plurality of plastic components designed to collect, direct, compress and exhaust air to provide a source of low pressure, high volume air.

In a preferred embodiment, the electric air pump includes an outer housing having an air intake port for admitting air into the pump and an air exhaust port for discharging low pressure, high volume air to an inflatable device. The outer housing typically is comprised of rigid plastic, supported by a pair of support legs with outward extending feet, and includes a carrying handle. An electric motor is mounted within the outer housing for providing rotation to an output shaft of the motor. Parallel mounted on the output shaft of the motor is a first air impeller and a second air impeller for drawing air into the air intake port and across the electric motor to provide heat dissipation. Mounted to the forward end of the electric motor but aft of the first and second air impellers is an air compressor chamber employed for collecting the air drawn into the air pump via the air intake port.

The rear side of the air compressor chamber includes a first plurality of curved pathways each having an open port at an end of each of the pathways for directing air through the air compressor chamber. Once the air passes through the open port, it is directed along a second plurality of curved pathways located on a forward side of the air compressor chamber. The air is then directed from the second plurality of curved pathways onto the first and second air impellers. Each of the first and second air impellers include a plurality of fins molded onto a forward surface of the air impellers in a curvilinear pattern. The air impellers which rotate at the speed of the output shaft of the electric motor compress the heated air and exhaust it out of the air exhaust port. The exhausted air directed out of the air exhaust port forms a stream of low pressure, high volume air for use in charging inflatable devices (not shown).

In the present invention, the rear end of the electric motor mounted within the outer housing of the electric air pump is supported by a rear motor support ring. The rear motor support ring exhibits an outer ring that fits snugly within the circumference of the outer housing and an inner ring concentric with the outer ring that serves to support a motor shock support at the rear end of the electric motor. The forward end of the electric motor is supported by the outer circular structure of the air compressor chamber that fits snugly within the circumference of the outer housing. Positioned between the first air impeller and the second air impeller is an air directional disk. The air directional disk is molded to an inside surface of the outer housing of the electric air pump. The forward surface of the air directional disk generally includes a plurality of segments spiraling from its outer circumference to a center penetration for forcing the air into the air impellers.

The present invention is generally directed to an electric air pump having multiple impellers parallel mounted on the same motor shaft and typically employed for providing a source of low pressure, high volume air. The source of low pressure, high volume air is typically utilized as a stream of forced air for charging inflatable devices. The multiple impellers provide improved motor efficiency in heat dissipation and air volume delivery when compared to a single impeller motor operating at the same RPM, and exhibit a near zero True Indicator Reading (TIR). In its most fundamental embodiment, the electric air pump having multiple impellers exhibits a construction including an outer housing having an air intake port and an air exhaust port. An electric motor is mounted within the outer housing and includes a rotating output shaft. A plurality of air impellers each parallel mounted on the rotating output shaft is employed for drawing a volume of air through the air intake port and across the electric motor. An air compressor chamber is positioned between the electric motor and the air impellers for collecting the air while the air impellers compress and exhaust the air through the air exhaust port for providing a supply of pressurized air.

These and other objects and advantages of the present invention will become apparent from the following more detailed description, taken in conjunction with the accompanying drawings which illustrate the invention, by way of example.

DESCRIPTION OF THE INVENTION

Figure 2:
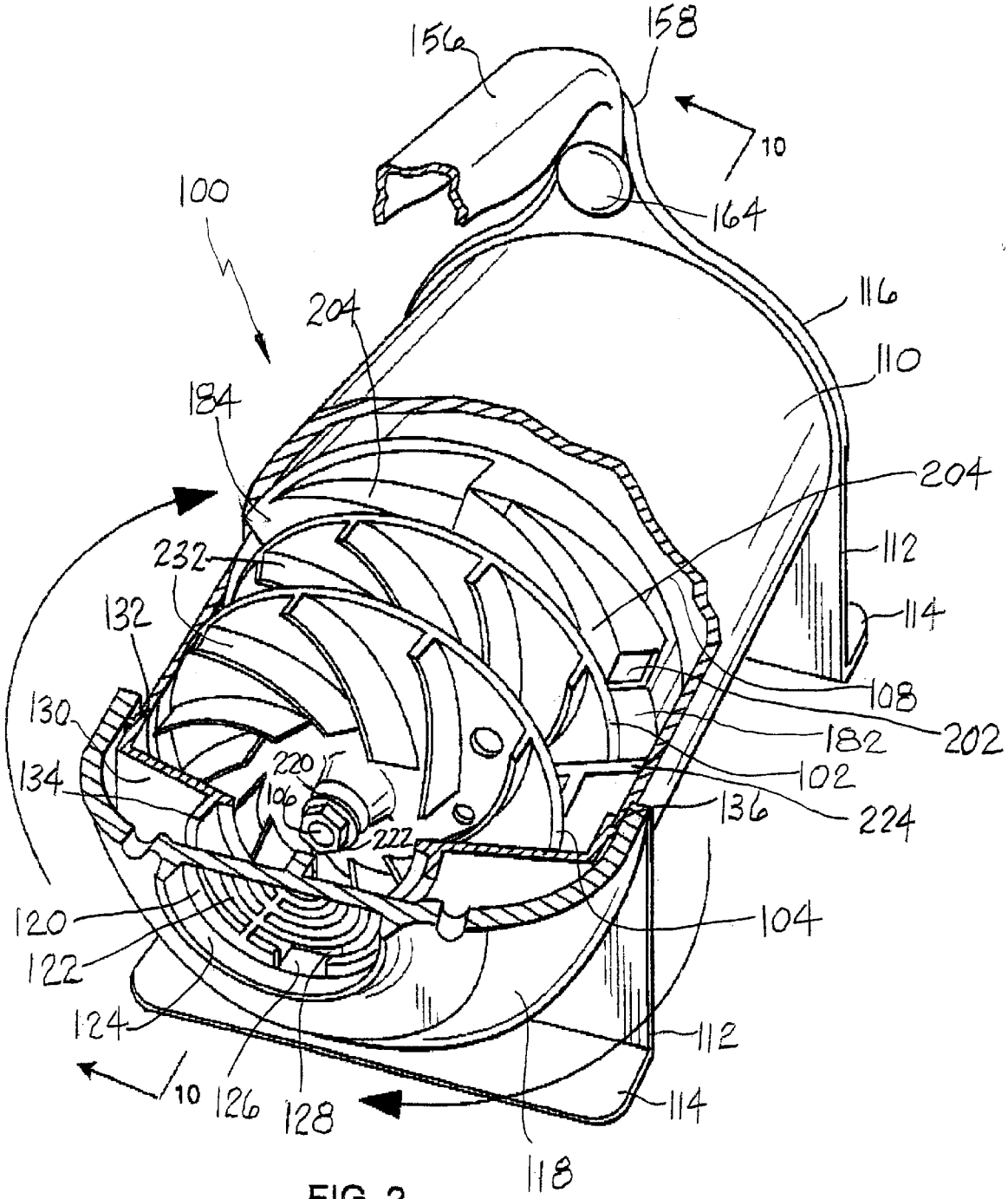
FIG. 2 is a second perspective view of the electric air pump of FIG. 1 with the outer housing partially cutaway at the exhaust end of the pump for exhibiting first and second impellers parallel mounted upon a rotating shaft extending from the electric motor within the air pump.
Figure 3:
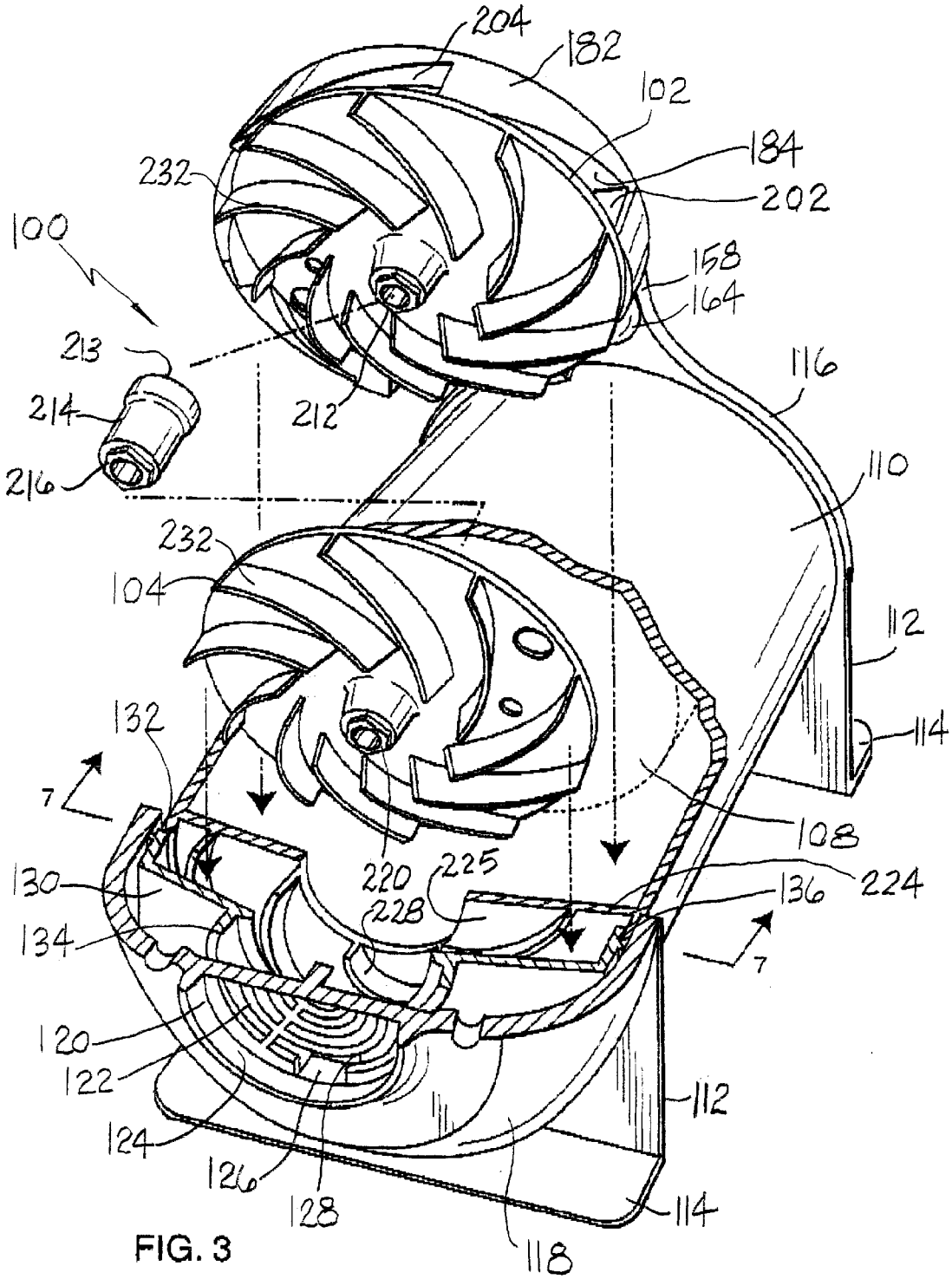
FIG. 3 is a third perspective view of the electric air pump of FIG. 1 showing the first and second impellers exploded away from the exhaust end of the outer housing with an air compressor chamber positioned behind the first impeller.
Figure 4:
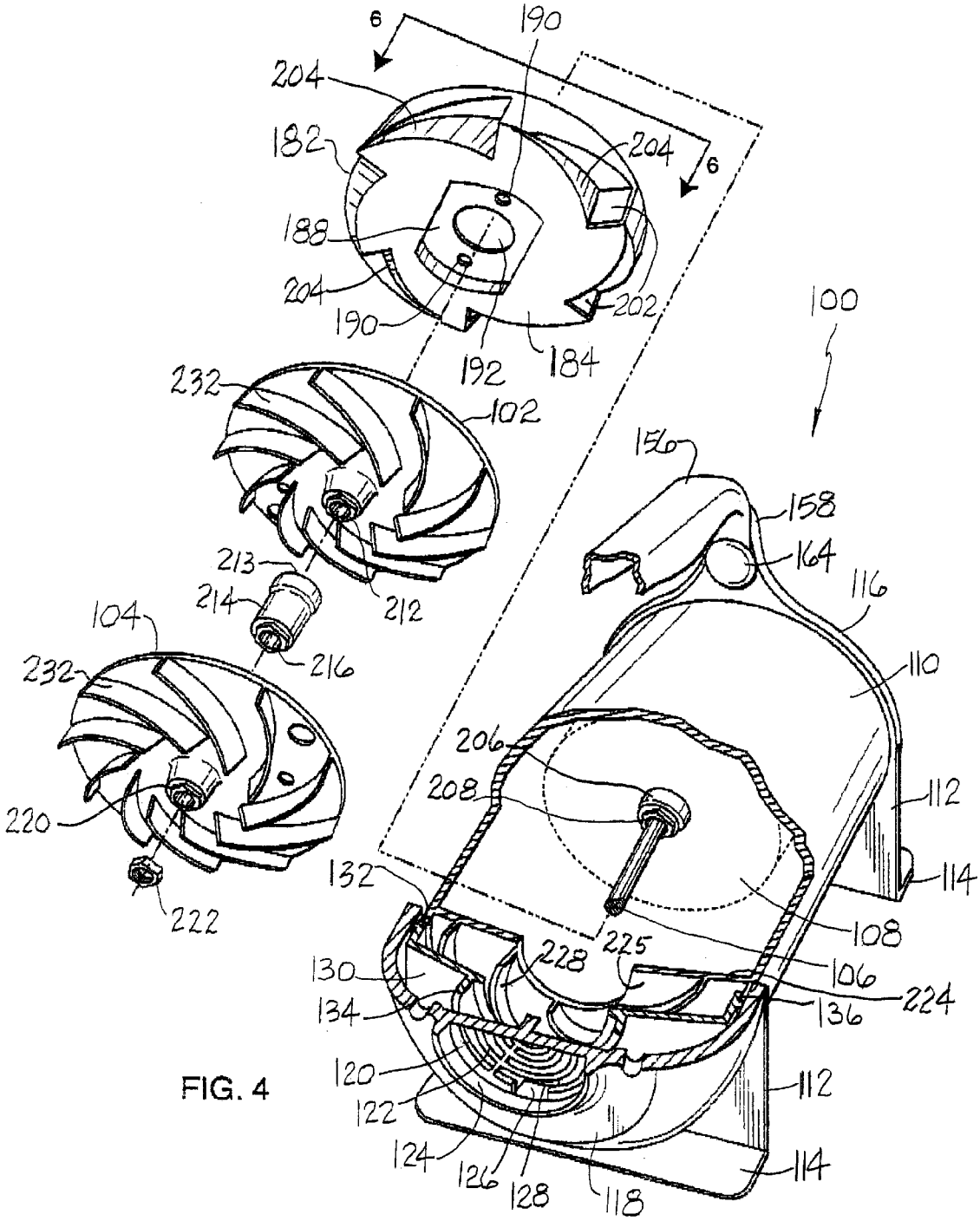
FIG. 4 is an exploded view of the electric air pump of FIG. 1 showing the first and second impellers and the air compressor chamber each separated from the axle of the electric motor.

The present invention is an electric air pump 100 having multiple air impellers, i.e., a first air impeller 102 and a second air impeller 104, parallel mounted on a rotating output shaft 106 of an electric motor 108 best shown in FIGS. 2, 3 and 4 and method therefore. The electric air pump 100 is typically employed for charging an inflatable device (not shown) with a stream of forced air, i.e., normally low pressure, high volume air. The first air impeller 102 and the second air impeller 104 provide improved motor efficiency in heat dissipation and air volume delivery compared to single impeller motors of the past.

Figure 1:
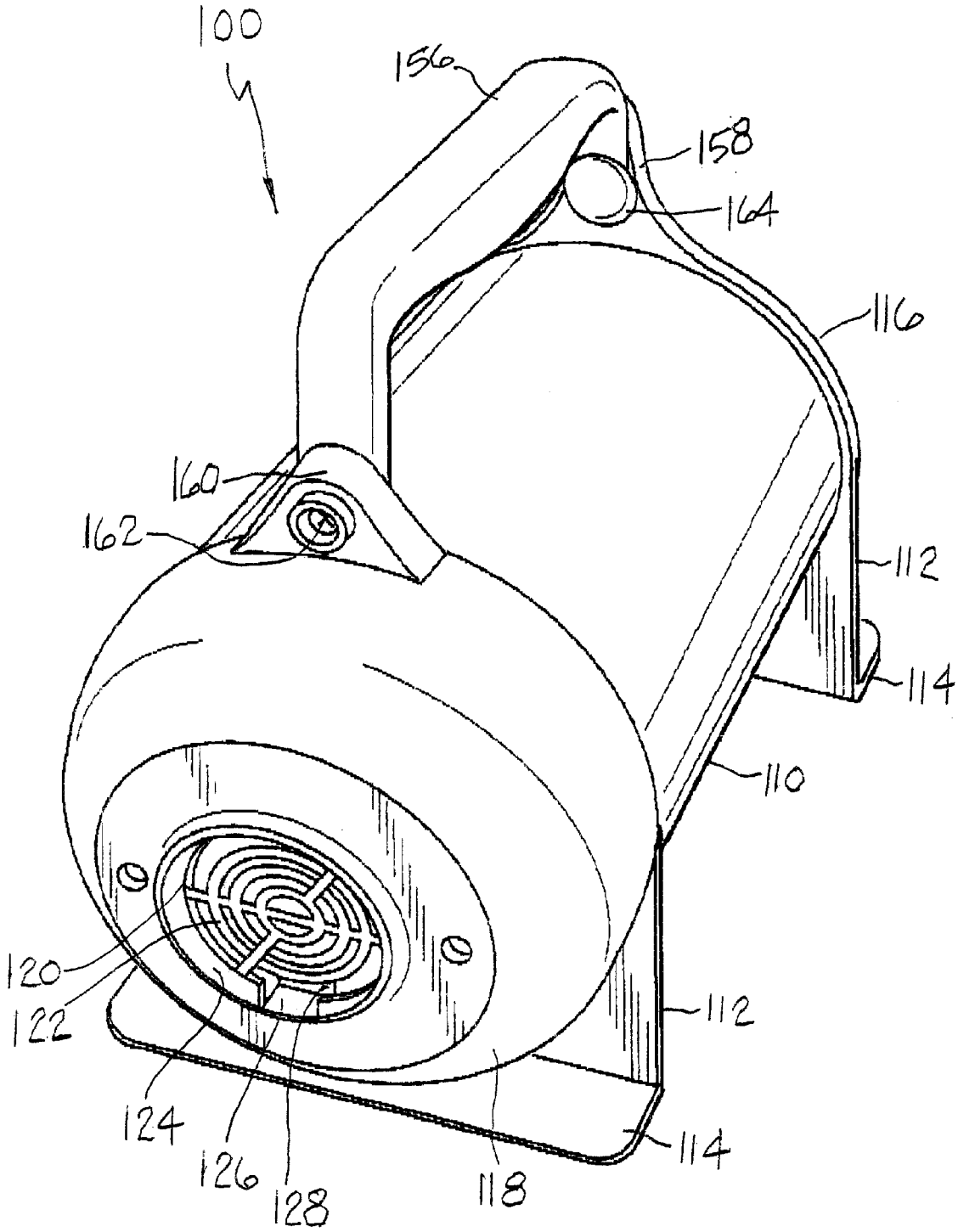
FIG. 1 is a first perspective view of an electric air pump having multiple impellers of the present invention showing the air pump enclosed within an outer housing mounted upon two support feet, and having a carrying handle.
Figure 7:
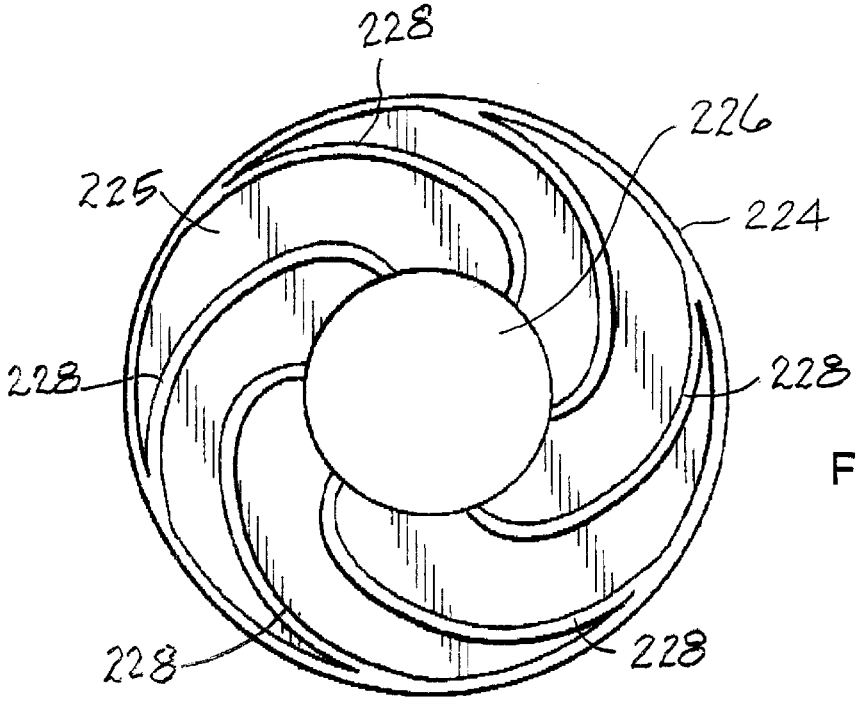
FIG. 7 is a front elevational view of an air directional disk molded to the inside surface of the outer housing of the air pump having a center penetration through which the axle of the electric motor extends.
Figure 8:
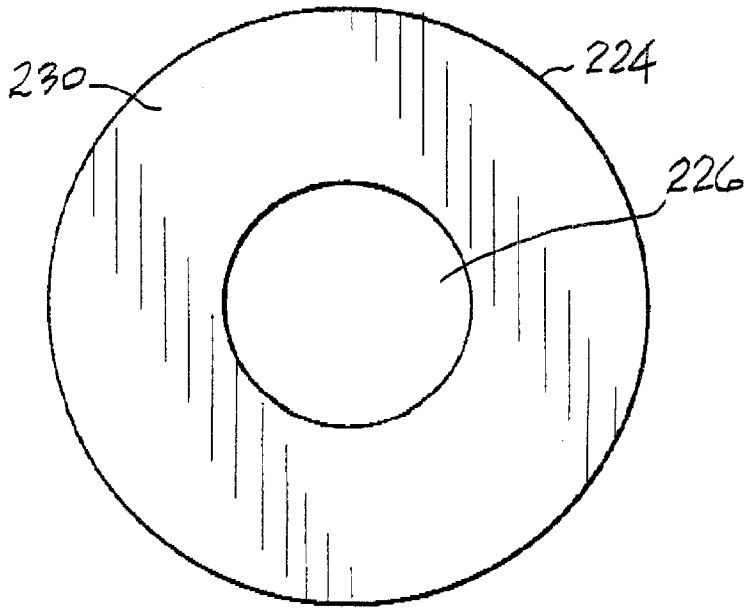
FIG. 8 is a rear elevational view of the air directional disk of FIG. 7 showing a flat surface that faces the front end of the electric motor.
Figure 9:
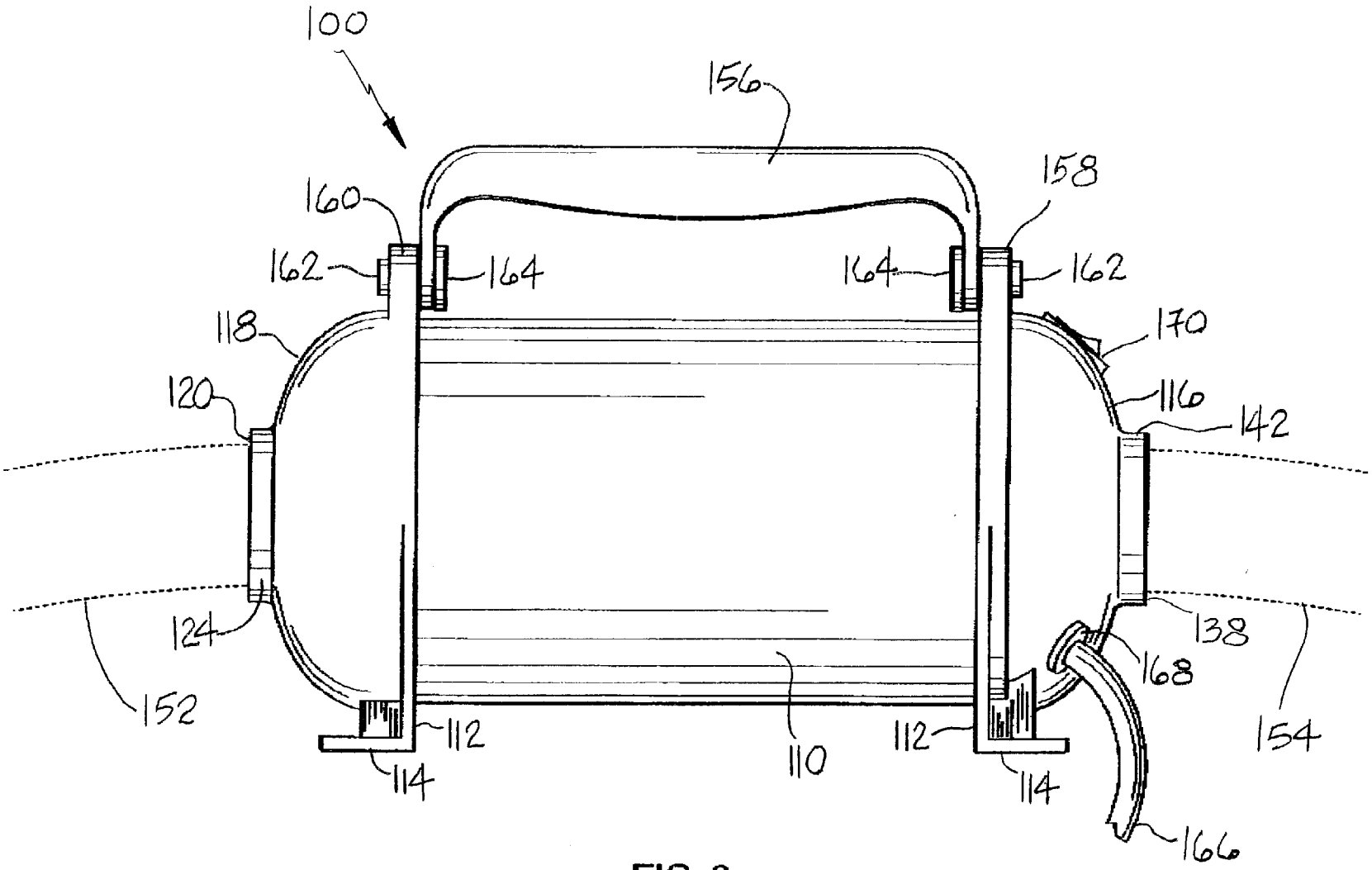
FIG. 9 is a side elevational view of the electric air pump of FIG. 1 showing an air intake port, air exhaust port, on-off switch, electric cable, carrying handle and support feet, with an air intake hose and an air exhaust hose each shown in phantom connected to the air intake port and the air exhaust port, respectively.

The preferred embodiment of the present invention of the electric air pump 100 is illustrated in FIGS. 1–10 herein. The general external structure of the electric air pump 100 is shown in FIG. 1 and includes an outer housing 110 having a pair of support legs 112 each having a corresponding outwardly extended footing 114. The outer housing 110 is generally cylindrical in shape having a smooth external surface as is shown in FIGS. 1 and 9. It is noted that each of the interior and exterior components of the outer housing 110 is comprised of a suitable rigid plastic material. The outer housing 110 includes a rear end assembly 116 and a forward end assembly 118 as is best shown in FIG. 9. Both the rear end assembly 116 and the forward end assembly 118 are unitary molded pieces having a generally cup-shaped appearance. It is noted that a first of the support legs 112 and corresponding outwardly extended footing 114 is molded to the rear end assembly 116. Likewise, a second of the support legs 112 and corresponding outwardly extended footing 114 is molded to the forward end assembly 118 as is shown in Fig.

The forward end assembly 118 includes an air exhaust port 120 for exhausting low pressure, high volume air from the outer housing 110 of the electric air pump 100. Molded to and extending across the air exhaust port 120 of the front end assembly 118 is a forward air exhaust grill 122 as is clearly shown in FIG. 1. The forward air exhaust grill 122 is circular in shape and is comprised of a suitable rigid plastic material and includes a forward lip 124 extending forward of the air exhaust grill 122. A small gap 126 is formed in the air exhaust grill 122 as shown in FIG. 1. Attached to the forward lip 124 and extending rearwardly of the small gap 126 of the air exhaust grill 122 is a first upwardly extending protuberance 128 as is shown in FIGS. 1 and 2.

Positioned immediately behind the forward end assembly 118 is a support disk 130 best shown in FIGS. 2 and 3. The support disk 130 provides structural support to the forward end assembly 118 and is attached to a forward terminal end 132 of the outer housing 110 with, for example, an adhesive. The support disk 130 also includes a forward circular extension 134 that surrounds the forward air exhaust grill 122 shown best in FIGS. 2 and 3. A pair of fasteners extending through a threaded channel (not shown) are utilized to affix the support disk 130 to the forward end assembly 118. The forward end assembly 118 is also attached to the forward terminal end 132 of the outer housing 110 with, for example, an adhesive at a forward attachment point 136 as is clearly shown in FIGS. 2, 3 and 10. The first of the support legs 112 is shown extending downward from the forward end assembly 118 in FIG. 9.

Figure 10:
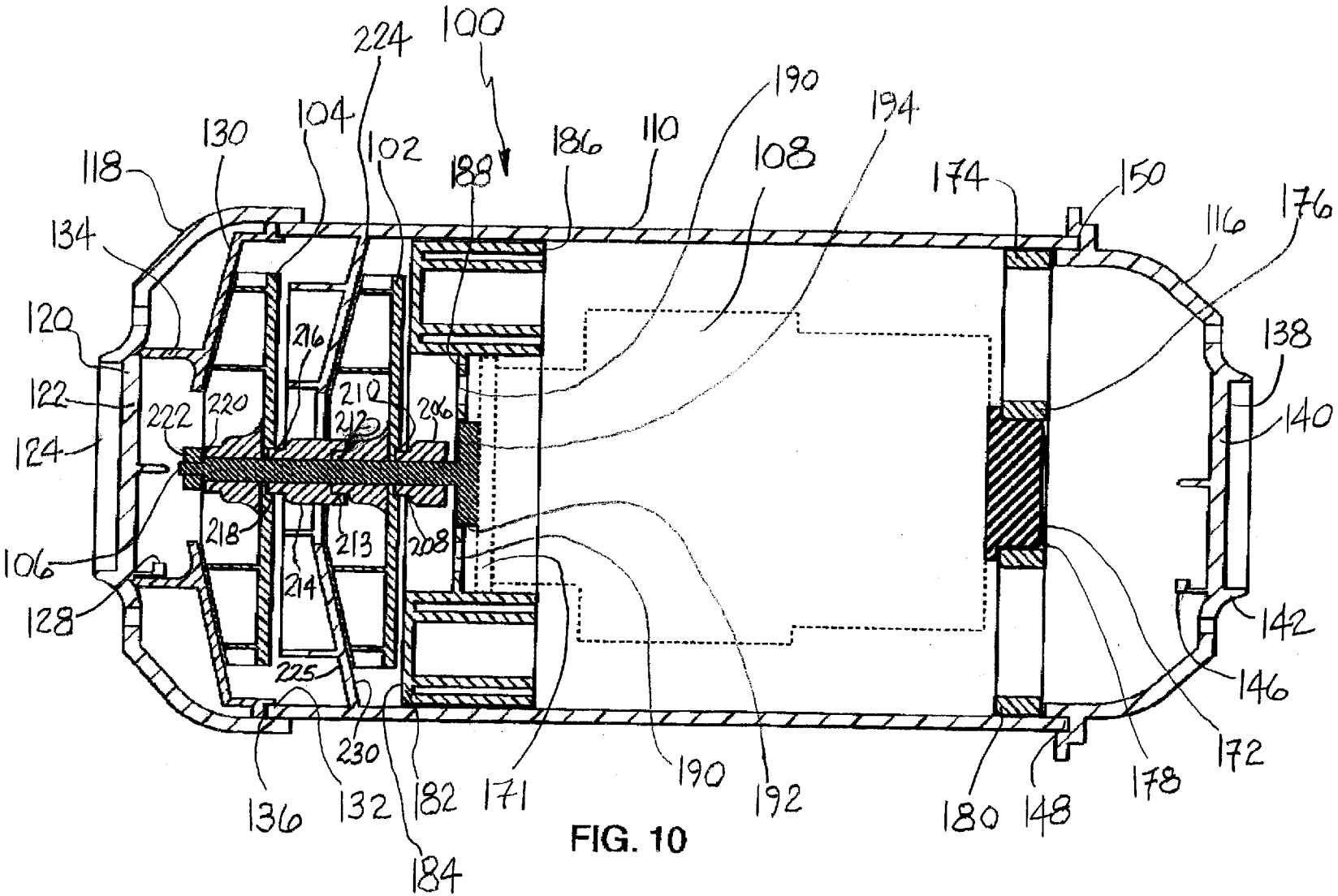
FIG. 10 is a cross-sectional view of the electric air pump of FIG. 1 taken along the longitudinal axis line 10—10 of FIG. 2 (with the support legs removed) and showing the pair of parallel mounted impellers on the rotating axle of the electric motor.

The rear end assembly 116 includes an air intake port 138 for drawing ambient air into the outer housing 110 of the electric air pump 100. The construction of the air intake port 138 and its associated components is essentially duplicate to the air exhaust port 120 described hereinabove. Molded to and extending across the air intake port 138 of the rear end assembly 116 is a rear air intake grill 140 as is shown in FIGS. 9 and 10. The rear air intake grill 140 is circular in shape and is comprised of a suitable rigid plastic material and includes a rearward lip 142 extending rearward of the air intake grill 140. A small gap 144 is formed in the air intake grill 140 in the same manner as the small gap 126 is formed in the air exhaust grill 122. Attached to the rearward lip 142 and extending forwardly of the small gap 144 of the air intake grill 140 is a second upwardly extending protuberance 146 as is shown in FIG. 10. The outer housing 110 also includes a rear terminal end 148 on a side oppose to the forward terminal end 132 as is shown in FIG. 10. The generally cup-shaped form of the rear end assembly 116 is attached to the rear terminal end 148 with, for example, an adhesive at a rear attachment point 150. The second of the support legs 112 is shown extending downward from the rear end assembly 116 in FIG. 9.

Extending from the air exhaust port 120 is an air exhaust hose 152 shown in phantom in FIG. 9. The air exhaust hose 152 can be positioned on the forward lip 124 of the air exhaust grill 122 for attaching to the first upwardly extending protuberance 128 through the small gap 126. The air exhaust hose 152 is employed to carry the low pressure, high volume air generated by the electric air pump 100 from the air exhaust port 120 to, for example, an inflatable device (not shown) for charging the inflatable device (not shown) with air. In the alternative, the stream of low pressure, high volume air can be delivered by the air exhaust hose 152 to another device.

Extending from the air intake port 138 is an air intake hose 154 also shown in phantom in FIG. 9. Typically, ambient air is drawn into the outer housing 110 directly through the air intake port 138. However, the air intake hose 154 can be useful under certain circumstances. For example, the air intake hose 154 can be utilized to draw air into the outer housing 110 from a particular source other than the ambient atmosphere. It may be useful to utilize the electric air pump 100 to exhaust air from a previously charged inflatable device such as, for example, an air mattress. Thus, if the air intake hose 154 is attached to the air valve (not shown) of, for example, an inflatable air mattress, the electric air pump 100 can be utilized to withdraw the air from the air mattress (not shown). Under these conditions, the air intake hose 154 can be attached to the air intake port 138 in the exact same manner as the air exhaust hose 152 is attached to the air exhaust port 120 described hereinabove.

The external structure of the electric air pump 100 also includes a carrying handle 156 as is clearly shown in FIGS. 1 and 9. The carrying handle 156 is comprised of molded plastic and is attached to a pair of risers 158, 160 each of which is a mirror image of the other. The riser 158 is molded to the top surface of the rear end assembly 116 while the riser 160 is molded to the top surface of the forward end assembly 118. Each of the risers 158, 160 includes a penetration (not visible) formed therein to enable the passage of a threaded fastener 162 therethrough. The threaded fastener 162 is then threaded into a threaded plastic receiver 164 as shown in FIG. 1. Once assembled, the carrying handle 156 is adjusted so that is will swivel thus enabling the handle to be swivelly rotated to one side when not in use.

Additionally, the external structure of the electric air pump 110 includes an electric feed cord 166 entering the rear end assembly 116 via a grommet or strain relief 168 as shown in FIG. 9. The electric feed cord 166 delivers approximately 120 volt, single phase, 60 Hertz electric power to the electric motor 108 from a standard electric outlet (not shown). To facilitate control of the electric air pump 100, an on-off switch 170 is wired into the circuitry of the electric motor 108 and mounted in the rear end assembly 116 as shown in FIG. 9. Additionally, the bottom surface of each of the outwardly extended footing 114 can include a non-slip pad (not shown) fabricated from a rubber-like material to minimize slipping of the electric air pump 100.

The prime mover for driving the first air impeller 102 and the second air impeller 104 is the electric motor 108 which is shown in phantom in FIGS. 3, 4 and 10. A wide variety of single phase motors are available and can be employed as the electric motor 108 of the electric air pump 100 of the present invention. For example, fractional horsepower motors of the alternating current (AC) or the direct current (DC) variety would be suitable for the present application. The electric feed cord 166 includes a three-wire service comprised of an energized single phase line and a neutral line having a nominal voltage between the two lines of 120 volts AC, single phase. Additionally, a ground wire is included which is affixed to the frame 171 of the electric motor 108 to avoid electric shock due to an inadvertently grounded electric conductor. In the present invention, a stator (field) winding is excited by the 120 Volt AC input. The same 120 volt AC input is also delivered to the rotor (armature) winding through a set of pig-tail leads, brushes and a commutator. When the on-off switch 170 is positioned to the on-position, the rotor winding is caused to rotate carrying the rotating output shaft 106 along with it. The direction of rotation (i.e., clockwise) is shown by the curved arrows at the forward end of the electric air pump 100 in FIG. 2. However, in certain motors, reversing the terminal connections of the single phase line and the neutral line will result in reversing the direction of rotation of the motor 108. Since the first air impeller 102 and the second air impeller 104 are each mounted upon the rotating output shaft 106, the two air impellers 102 and 104 rotate with the output shaft 106.

The electric motor 108 is supported within the outer housing 110 to minimize mechanical vibrations. A motor shock support 172 typically comprised of rubber or other resilient material is positioned over the rear end of the electric motor 108. Mounted over the motor shock support 172 is a rear motor support ring 174 typically comprised of plastic as is clearly shown in FIG. 10. The rear motor support ring 174 includes a center donut portion 176 having a penetration 178 formed therethrough. It is through this penetration 178 that the motor shock support 172 extends. The center donut portion 176 includes a plurality of radial members (not shown) that connect to an outer ring 180 of the rear motor support ring 174. The outer ring 180 is dimensioned to snugly fit within the outer housing 110. Once the center donut portion 176 of the rear motor support ring 174 is fitted over the motor shock support 172, the outer ring 180 is snugly positioned within the outer housing 110. This construction ensures that the rear end of the electric motor 108 is secured in position to minimize vibration.

Figure 5:
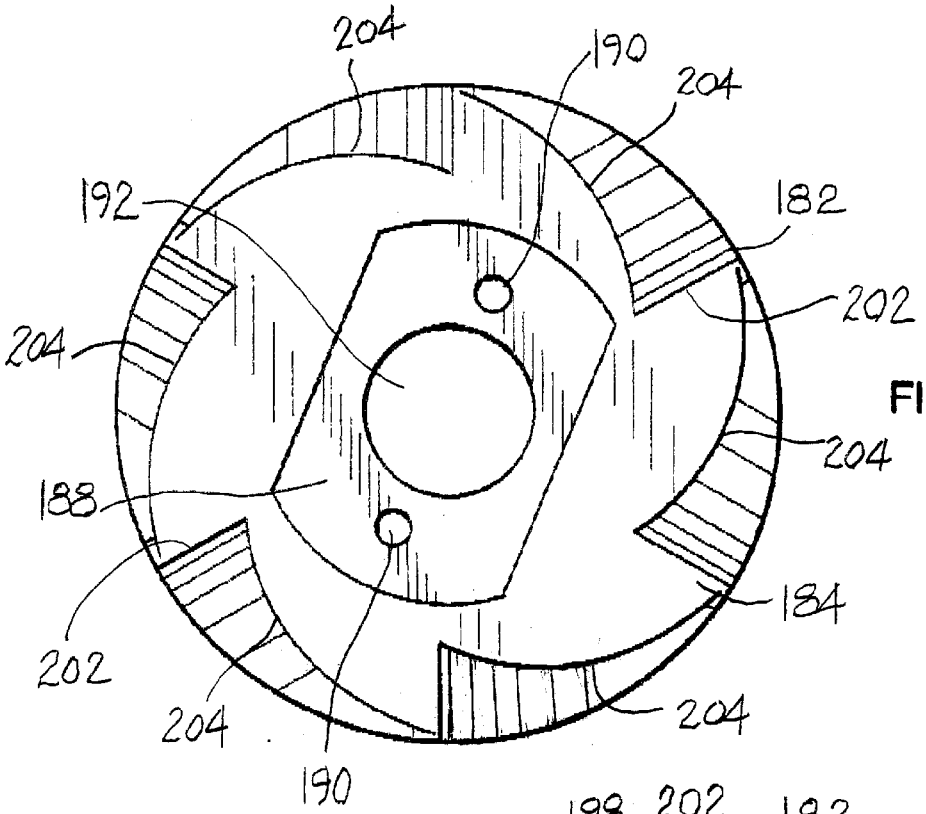
FIG. 5 is a front elevational view of the air compressor chamber normally mounted on the front end of the electric motor and generally illustrating the curvilinear construction of the air compressor chamber for directing air to the first and second impellers.
Figure 6:
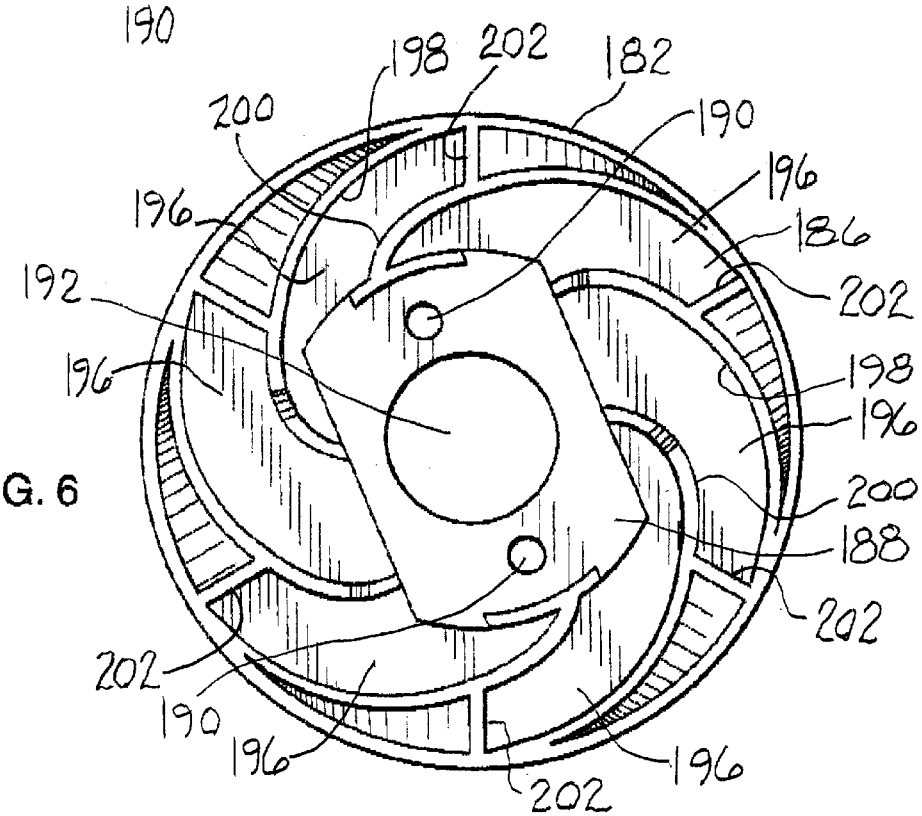
FIG. 6 is a rear elevational view of the air compressor chamber and illustrating the multiple centrifugal pathways for directing air in curvilinear motion to the first and second impellers.

Stationarily mounted to the forward portion of the frame 171 of the electric motor 108 is an air compressor chamber 182 best shown in FIGS. 5–6 but also shown in FIGS. 2–4 and the cross-sectional view of FIG. 10. The air compressor chamber 182 is molded of plastic and formed in the shape of a disk having a forward side 184 shown in FIG. 5 and a rear side 186 shown in FIG. 6. When viewed from the forward side 184 in FIG. 5, the air compressor chamber 182 includes a quasi-rectangular depression 188. The depression 188 appears as a raised portion when viewed from the rear side 186 in FIG. 6. The quasi-rectangular depression 188 includes a pair of penetrations 190 formed therethrough which are positioned around a center penetration 192 formed through the depression 188 of the air compressor chamber 182.

The air compressor chamber 182 is stationarily mounted to the electric motor 108 in the following manner. The frame 171 of the electric motor 108 includes a forward portion 194 securely attached thereto. The forward portion 194 is passed through the center penetration 192 formed through the depression 188 of the air compressor chamber 182. Thereafter, a pair of threaded fasteners (not shown) are passed through the pair of penetrations 190 and into a corresponding pair of threaded receptacles (not shown) adjacent to the forward portion 194 of the frame 171. Once the threaded fasteners (not shown) are anchored, the air compressor chamber 182 is mechanically attached to the frame 171 of the electric motor 108. After it is securely attached to the frame 171, the air compressor chamber 182 functions as a forward motor mount to minimize mechanical vibrations of the electric motor 108. This feature is possible since the diameter of the air compressor chamber 182 is dimensioned to snugly fit within the outer housing 110 (in a manner similar to that of the outer ring 180 of the rear motor support ring 174 discussed hereinabove).

When the electric motor 108 is energized and the output shaft 106 is rotating, both the first air impeller 102 and the second air impeller 104 rotate with the output shaft 106. Rotation of the first air impeller 102 and the second air impeller 104 causes ambient air to be drawn into the rear end assembly 116. The ambient air is pulled across the energized electric motor 108 and is heated in the process. Because of the position of the air compressor chamber 182, the ambient air must necessarily contact the rear side 186 thereof. The air compressor chamber 182 is a uniquely designed component of the present invention that functions to direct the heated ambient air passing through the outer housing 110 to the first air impeller 102 and the second air impeller 104. In the description of several of the components of the present invention, the term "curvilinear" will be utilized. The meaning attached to this term is "formed, bounded, or characterized by curved lines" as is recited in American Heritage Dictionary, 2nd Ed., Copyright 1976.

The rear side 186 of the air compressor chamber 182 is clearly shown in FIG. 6. The quasi-rectangular depression 188 appears as a raised portion when viewed from the rear side 186 and is the center of the air compressor chamber 182. In particular, the construction of the rear side 186 exhibits a plurality of six centrifugal channels 196 as shown in FIG. 6. Each of the centrifugal channels 196 exhibits a curvilinear path which curves away from the center penetration 192. Each centrifugal channel 196 includes a pair of borders 198 and 200 which serve to direct a mass of air to and through a window 202 best shown in FIGS. 2 and 4. During operation of the electric motor 108, the air pulled into the rear end assembly 116 and across the motor 108 is directed into the plurality of centrifugal channels 196 and through the corresponding window 202 formed at the end of each channel 196. The air passing through each of the windows 202 is directed to the first air impeller 102 and the second air impeller 104, respectively.

The forward side 184 of the air compressor chamber 182 shown in FIG. 5 includes the plurality of windows 202 which serve as six air inlets through which air is pulled toward the first air impeller 102 and the second air impeller 104 as is shown in FIG. 2 and also in the exploded view of FIG. 4. Just forward of each of the windows 202 is a triangular depression 204 for directing the air from the forward side 184 of the air compressor chamber 182. Each of the triangular depressions 204 have graduated dimensions along the length of the curvilinear arc and is actually the forward side of the corresponding curvilinear centrifugal channel 196 on the rear side 186 of the air compressor chamber 182. Thus, the function of the stationary air compressor chamber 182 is to direct the heated air onto the rotating first air impeller 102 and the rotating second air impeller 104.

Fixedly mounted on the rotating output shaft 106 of the motor 108 is a first plastic nut 206 which extends through the center penetration 192 of the air compressor chamber 182 as is shown in FIG. 4. The first plastic nut 206 includes a hexagon shaped head 208 which snugly fits into a first hexagon-shaped receptacle 210 formed in the flat back side of the first air impeller 102 as shown in FIG. 10. The first air impeller 102 is seated on the first plastic nut 206 mounted to the rotating output shaft 106. The forward side of the first air impeller 102 includes a second hexagon shaped nut 212 molded thereon which fits into a second hexagon-shaped receptacle 213 formed in the rear side of a separate slide-on cylinder 214 as is shown in FIGS. 4 and 10.

The forward side of the separate slide-on cylinder 214 includes a third hexagon-shaped nut 216 extending therefrom. The third hexagon-shaped nut 216 fits into a third hexagon-shaped receptacle 218 formed in the flat back side of the second air impeller 104. Likewise, the forward side of the second air impeller 104 includes a fourth hexagon-shaped nut 220. The rotating output shaft 106 passes through each of the first, second, third and fourth hexagon-shaped nuts 206, 212, 216 and 220, respectively. Additionally, the rotating output shaft 106 passes through each of the first, second and third hexagon-shaped receptacles 210, 213, and 218, respectively, as is shown in FIG. 10. Mounted on the threaded end of the rotating output shaft 106 is a threaded nut 222 which secures each of these connection components together in a unitary manner.

The first air impeller 102 is separated from the second air impeller 104 by an air directional disk 224 molded to the inside surface of the outer housing 110 as shown in FIGS. 7 and 8. The illustration in FIG. 7 shows a forward side 225 of the air directional disk 224. The air directional disk 224 includes a central penetration 226 from which a plurality of centrifugal blades 228 emanate. A rear side 230 of the air directional disk 224 shown in FIG. 8 is a flat surface. The function of the air directional disk 224 is to further direct the heated air from a first stage of compressing and exhausting, i.e., the first air impeller 102, to a second stage of compressing and exhausting, i.e., the second air impeller 104. The rotating output shaft 106 including each of the hexagon-shaped nuts 206, 212, 216 and 220 and the corresponding hexagon-shaped receptacles 210, 213 and 218 pass through the central penetration 226 of the air directional disk 224.

Both the first air impeller 102 and the second air impeller 104 includes a plurality of fins or fan blades 232 best shown in FIGS. 2, 3 and 4. The fins 232 serve to pull the air from the rear end assembly 116 past the motor 108 and through the air compressor chamber 182. It is the first air impeller 102 and the second air impeller 104 in combination with the plurality of fins 232, each rotating with the output shaft 106 of the motor 108, that simultaneously gathers, compresses and then exhausts the heated air out of the air exhaust port 120. It is this combination of structure that provides the low pressure, high volume air generated by the electric air pump 100 of the present invention.

The present invention provides novel advantages over other air pumps for use with, for example, inflatable devices (not shown) known in the prior art. A main advantage of the electric air pump 100 of the present invention is that multiple impellers (i.e., first impeller 102 and second impeller 104) are parallel mounted on the same rotating output shaft 106 of the electric motor 108. Use of the first air impeller 102 and the second air impeller 104 provide improved motor efficiency in heat dissipation and air volume delivery when compared to a single impeller motor of the prior art operating at the same RPM. Thus, the electric air pump 100 of the present invention is significantly more efficient in gathering and driving air through the air exhaust port 120 of the electric air pump 100. The increase in efficiency is approximately linear as the number of impellers is increased. Additionally, the multiple parallel mounted impellers 102 and 104 exhibit dimensions sufficiently exact so that a near zero True Indicator Reading (TIR) can be accomplished by manual assembly of the components of the motor 108.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

It is therefore intended by the appended claims to cover any and all such modifications, applications and embodiments within the scope of the present invention. Accordingly,

What is claimed is:

1. An electric air pump comprising:

an outer housing having an air intake port and an air exhaust port;

an electric motor mounted within said outer housing, said electric motor having a rotating output shaft;

a plurality of air impellers each having a plurality of fins and each parallel mounted on said rotating output shaft for drawing a volume of air through said air intake port and across said electric motor; and an air compressor chamber positioned between and in mechanical communication with said electric motor and said air impellers and being stationarily mounted to said electric motor, said air compressor chamber having a plurality of centrifugal channels for directing said air through a plurality of windows and a corresponding plurality of triangular depressions to said air impellers, said air impellers compressing and exhausting said air through said air exhaust port for providing a supply of pressurized air.

2. The electric air pump of claim 1 wherein said outer housing is comprised of plastic.

3. The electric air pump of claim 1 wherein each of said air impellers is comprised of plastic.

4. The electric air pump of claim 1 wherein said fins are moled onto a forward surface of said air impellers in curvilinear pattern.

5. The electric air pump of claim 1 wherein said plurality of air impellers include a first air impeller and a second air impeller, said first air impeller being separated from said second air impeller by a spacer.

6. The electric air pump of claim 1 further including an air directional disk positioned between said air impellers and molded to an inside surface of said outer housing for directing air to said air impellers.

7. The electric air pump of claim 1 further including an on-off switch.

8. The electric air pump of claim 1 wherein said air intake port includes a rear grill arranged for receiving an air intake hose.

9. The electric air pump of claim 1 wherein said air exhaust port includes a forward grill arranged for receiving an air exhaust hose.

10. The electric air pump of claim 1 further including a rear motor support ring positioned within said outer housing for supporting said electric motor.

11. The electric air pump of claim 1 further including a handle swivelly attached to said outer housing.

12. An electric air pump comprising:

an outer housing having an air intake port and an air exhaust port, said out housing comprised of plastic;

an electric motor mounted with in said outer housing, said electric motor having a rotating output shaft;

a plurality of air impellers each having a plurality of fins and each parallel mounted on said rotating output shaft for drawing a volume of air through said air intake port and across said electric motor, said plurality of air impellers comprising a first air impeller and a second air impeller; and an air compressor chamber positioned between and in mechanical communication with said electric motor and said air impellers and being stationarily mounted to said electric motor, said air compressor chamber having a plurality of centrifugal channels for directing said air through a plurality of windows and a corresponding plurality of triangular depressions to said air impellers, said air inpellers compressing and exhausting said air trough said air exhaust port for providing a supply of pressurized air.

13. The electric air pump of claim 12 wherein said first air impeller is separated from said second air impeller by a spacer.

14. The electric air pump of claim 12 further including an air directional disk positioned between said first air impeller and said second air impeller and molded to an inside surface of said outer housing for directing air to said air impellers.

15. An electric air pump comprising:

an outer housing having an air intake port and an air exhaust port;

an electric motor mounted within said outer housing, said electric motor having a rotating output shaft;

a plurality of air impellers each parallel mounted on said rotating output shaft for drawing a volume of air through said air intake port and across said electric motor, each of said air impellers including a plurality of fins;

an air compressor chamber positioned between and in mechanical communication with said electric motor and said air impellers and being stationarily mounted to said electric motor, said air compressor chamber having a plurality of centrifugal channels for directing said air through a plurality of windows and a corresponding plurality of triangular depressions to said air impellers, said air impellers compressing and exhausting said air through said air exhaust port for providing a supply of pressurized air; and an air directional disk positioned between said air impellers and molded to an inside surface of said outer housing for directing said air to said air impellers.

* * * * *